US006328040B1

(12) United States Patent
Stein

(10) Patent No.: US 6,328,040 B1
(45) Date of Patent: Dec. 11, 2001

(54) NAIL POLISH PEN HAVING SPARE TIPS

(76) Inventor: Julie Anne Stein, 19158 Golden Meadow Way, Noblesville, IN (US) 46060

( * ) Notice: Subject to any disclaimer, the term of this patent is extended or adjusted under 35 U.S.C. 154(b) by 0 days.

(21) Appl. No.: 09/631,446

(22) Filed: Aug. 2, 2000

(51) Int. Cl.[7] ..... A45D 34/04

(52) U.S. Cl. ..... 132/74.5; 132/75; 401/134

(58) Field of Search ..... 132/73, 73.5, 74.5, 132/75, 309, 311; 401/134, 135, 196, 199, 170, 172, 173, 174

(56) References Cited

U.S. PATENT DOCUMENTS

| | | | | |
|---|---|---|---|---|
| 1,671,125 | | 5/1928 | Pollock . | |
| 1,847,495 | * | 3/1932 | Priest | 132/309 |
| 2,046,002 | * | 6/1936 | Hunter | 132/74.5 |
| 2,100,173 | * | 11/1937 | Rubens | 132/73 |
| 2,293,211 | | 8/1942 | Mureau . | |
| 2,978,722 | | 4/1961 | Kusakabe . | |
| 3,341,884 | * | 9/1967 | Pryor | 132/74.5 |
| 3,720,473 | | 3/1973 | Nakata | 401/40 |
| 4,033,007 | * | 7/1977 | Hadary | 15/172 |
| 4,457,641 | * | 7/1984 | Smith | 401/135 |
| 4,599,008 | | 7/1986 | Furlong et al. | 401/133 |
| 4,640,637 | * | 2/1987 | Winthrop | 401/101 |
| 4,854,760 | | 8/1989 | Pike et al. | 401/134 |
| 5,342,136 | * | 8/1994 | Fukami | 401/135 |
| 5,377,703 | * | 1/1995 | Chou et al. | 132/311 |
| 5,762,077 | * | 6/1998 | Griffiths, Jr. | 132/74.5 |
| 5,829,976 | * | 11/1998 | Green | 433/89 |
| 5,996,591 | * | 12/1999 | Landa et al. | 132/200 |
| 6,035,860 | | 3/2000 | Mombourquette | 132/200 |
| 6,247,477 | * | 6/2001 | Wagner | 132/309 |

* cited by examiner

*Primary Examiner*—Gene Mancene
*Assistant Examiner*—David Comstock
(74) *Attorney, Agent, or Firm*—Woodard, Emhardt, Naughton, Moriarty & McNett

(57) ABSTRACT

A portable, easy to use nail polish pen or stylus for women who need to touch up, repair, or apply new nail polish to their fingernails while on the go. In one form, the nail polish pen includes a two piece elongated cylindrical body into which a disposable fingernail polish cartridge is placed. Upon combining the pen pieces, the polish cartridge is opened and the fingernail polish contained therein is directed to flow into a porous tip positioned in one end of the polish pen. The tip may then be stroked over the fingernails to coat them with polish. Spare tips are stored in a compartment in the nail polish pen.

7 Claims, 2 Drawing Sheets

NAIL POLISH PEN HAVING SPARE TIPS

TECHNICAL FIELD OF THE INVENTION

The present invention relates generally to personal grooming and, more particularly, to a stylus for applying polish or paint to fingernails.

BACKGROUND OF THE INVENTION

Fingernail polish is typically packaged in small bottles, each including a cap having an applicator brush extending therefrom. The caps typically screw onto the bottles, with the brush extending into the polish. In use, the cap is first unscrewed from the bottle and retracted therefrom to expose the polish-laden brush. Excess polish is then removed from the brush (usually by stroking the brush against the rim of the bottle) and polish is then applied to a fingernail by stroking the brush thereacross. During the application process, the bottle is customarily placed on a flat, stable surface, since it is difficult to hold the bottle in either hand while applying fingernail polish. After all of the desired fingernails have been polished, the bottle is recapped and stored until the next use.

The conventional bottle and brush fingernail polish storage and application system has several disadvantages. One such disadvantage is that typical fingernail polish bottles are not well suited for portability in pockets or purses. The bottles are irregularly shaped and have caps that typically protrude from the main bottle body. Such protruding caps are easily entangled with other items stored in a purse. Such entanglement of the caps and bottles with the remaining contents of a purse is inconvenient at least and may lead to loosening or premature removal of the cap while the bottle is still in the purse. Such a mishap could easily result in the nail polish contents of the bottle spilling onto the remaining contents and interior of the purse, damaging and/or ruining them.

Another disadvantage of the traditional nail polish bottle is the requirement that the bottle rest on a flat surface while a user applies the polish. This requirement arises as a user must hold the brush in one hand while applying polish to the other hand. Thus, the traditional design necessitates a flat and relatively stable surface to be present for the bottle in order for nail polish to be applied.

Still another disadvantage with the traditional nail polish bottle is solvent loss occurring at the bottle cap seal. Over time, the solvent that keeps the polish flowable is lost through the cap seal (this occurs faster once the bottle has been opened for the first time, but will occur nonetheless with unopened bottles), resulting in contents that are increasingly viscous and sticky. This is undesirable both because thickened nail polish provides a less even and attractive nail coat, and because thickened nail polish acts to glue the bottle cap to the bottle. Eventually, the polish becomes so thick from solvent loss that the polish is useless, even if the bottle can still be opened.

There is therefore a need for a nail polish container/applicator that may be easily carried about with minimized risk of solvent loss and that may be utilized without the need for a convenient and stable flat surface. The present invention is directed toward meeting this need.

SUMMARY OF THE INVENTION

The present invention relates to a stylus for containing and applying fingernail polish. The stylus includes an applicator end portion with an applicator tip extending therefrom, a hollow inner body portion adapted to contain a polish cartridge or packet, and an end enclosure portion adapted to hold spare tips. One embodiment of the present invention relates to a stylus having a matably threaded inner and outer body portion, the magnitude interior stylus volume defined therein for a polish packet being a function of how far the outer body portion is screwed onto the inner body portion. Decreasing the interior stylus volume likewise decreases the polish packet volume and urges polish to extrude from the stylus through the tip.

One object of the present invention is to provide an improved fingernail polish container. Related objects and advantages of the present invention will be apparent from the following description

DETAILED DESCRIPTION OF THE PREFERRED EMBODIMENT

Figure 1:
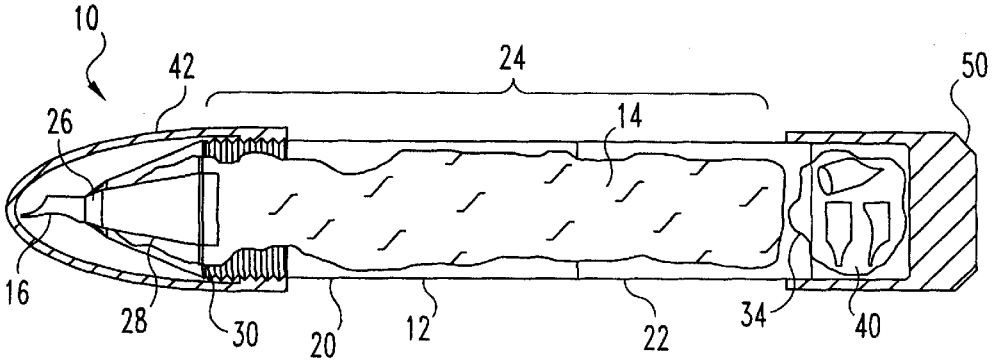
FIG. 1 is a partial sectional side elevational view of a first embodiment nail polish applicator stylus of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2A:
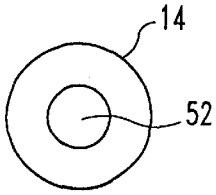
FIG. 2A is a front elevational view of a nail polish cartridge of the embodiment of FIG. 1.
Figure 2B:
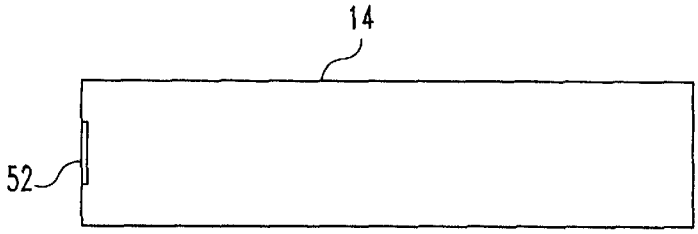
FIG. 2B is a side elevational view of FIG. 2A
Figure 3:
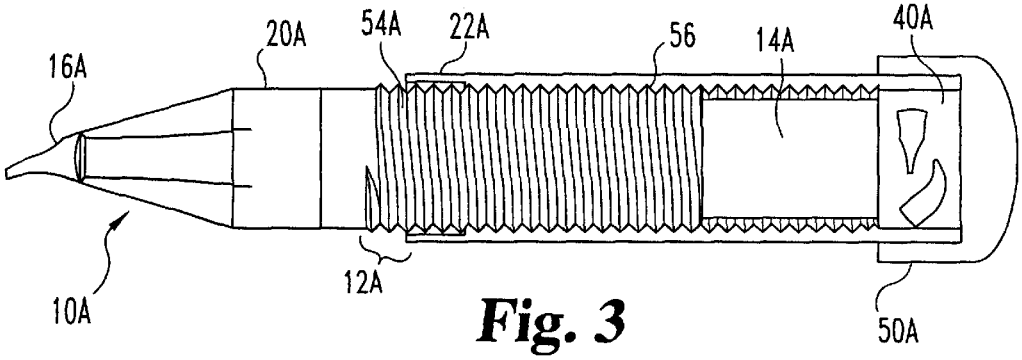
FIG. 3 is a partial sectional side elevational view of a second embodiment nail polish applicator stylus of the present invention.
Figure 4:
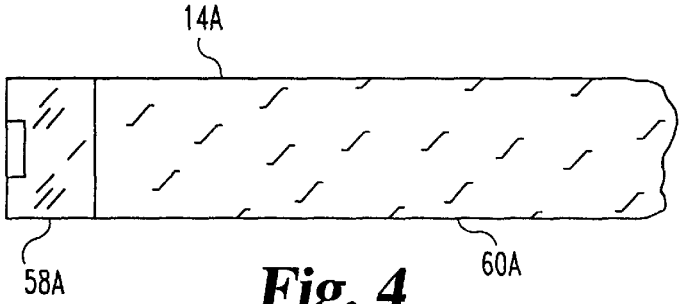
FIG. 4 is a side elevational view of a nail polish cartridge of the embodiment of FIG.3.
Figure 5A:
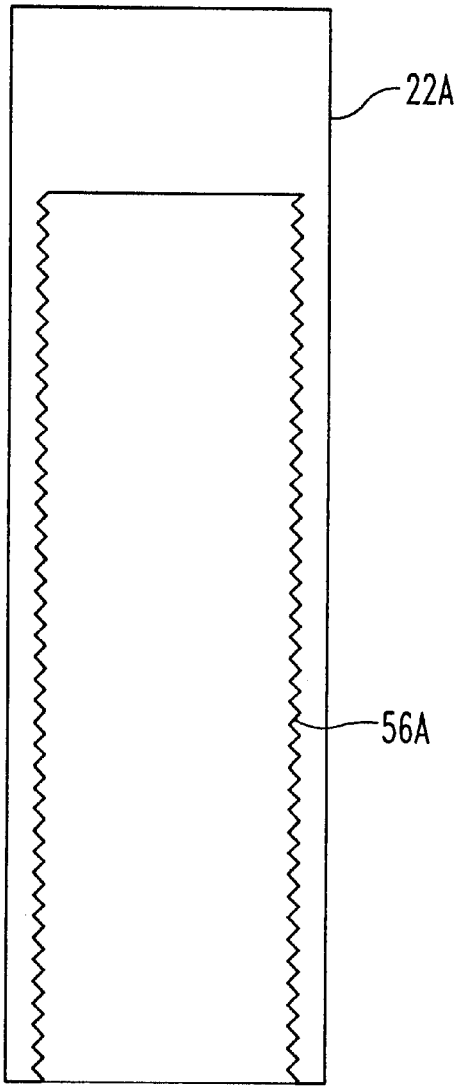
FIG. 5A is a schematic view of a distal portion of FIG. 3.
Figure 5B:
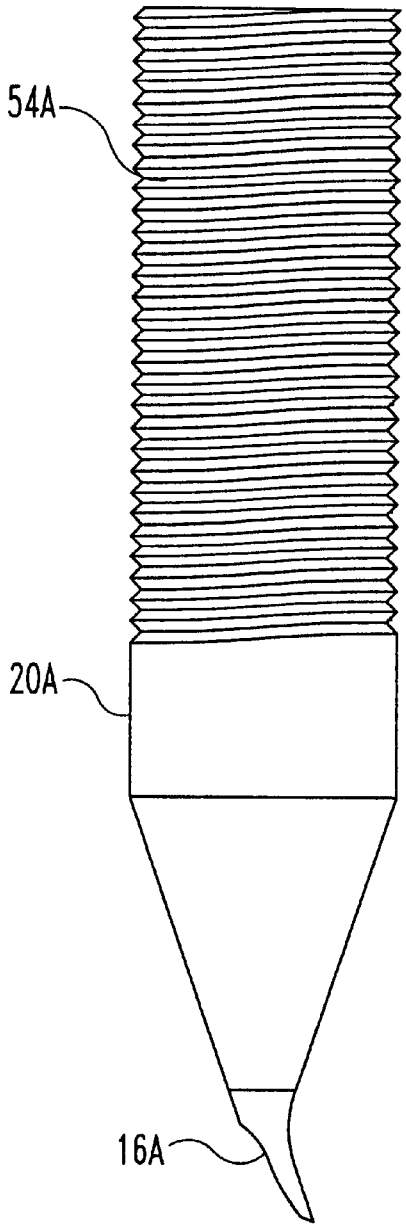
FIG. 5B is a schematic view of a proximal portion of FIG. 3

FIGS. 1, 2A, and 2B illustrate a first embodiment of the present invention, a stylus system 10 adapted to contain and direct a supply of fingernail polish. The stylus system 10 includes an elongated, generally cylindrical hollow body portion 12, a cartridge or fluid reservoir 14 adapted to rest within the body portion 12, and a tip portion 16, adapted to connect to the body portion 12 and extend therefrom.

The body portion 12 includes a first or proximal portion 20 and a second or distal portion 22. The first and second portions 20, 22 are connectable to define a central inner volume 24. The first and second portions 20, 22 may be connected by any convenient means, such as an interference fit, matable threads, or the like.

The first portion 20 further includes a tip holder 26 adapted to engage a tip portion 16. The tip portion 16 is preferably formed from some porous material, such as felt, nylon, or sponge. The tip portion 16 may be formed in a variety of shapes (i.e., flat, conical, wide, narrow, etc . . . ) and preferably several differently shaped tip portions 16 are provided for different polishing needs. The tip holder 26 is preferably positioned opposite the second portion 22. The tip holder 26 is operationally connected to the elongated hollow body portion 12 in fluid communication with the inner volume 24 by a polish conduit 28. In other words, the conduit 28 fluidically connects the tip portion 16 to the central inner volume 24. The polish conduit 28 includes a raised joint 30 extending into the inner volume 24. The raised joint 30 is preferably circular, but may have any convenient shape.

The second portion 22 further includes a biasing member 34 adapted to provide a biasing force to a cartridge 14 resting within the inner volume 24. The biasing member is preferably a spring or the like, and is more preferably positioned in the inner volume 24 opposite the first portion 20. The second portion 22 may also include a tip storage volume 40 wherein spare tips 16 may be kept pending their use.

The stylus system 10 further preferably includes a front cap 42 adapted to fit over an engaged tip 16 and the tip holder 26. The front cap 42 is preferably further adapted to snugly engage the first portion 20 to minimize solvent leakage therefrom. The front cap 42 is more preferably adapted to snugly engage the first portion 20 by means of an interference fit, but may alternately snugly engage the first portion 20 by any convenient engagement means. The stylus system 10 also preferably includes an end cap 50 adapted to enclose the tip storage volume 40.

The polish cartridge 14 is a generally cylindrical container for enclosing a volume of fingernail polish. The cartridge 14 is preferably sized to fit snugly within the inner volume 24, although the cartridge 14 may alternately be sized to fit loosely therein. The cart ridge 14 is preferably formed from some lightweight structural material such as aluminum or plastic. The cartridge 14 also preferably includes a foil sealed aperture 52 formed in one end thereof. The foil sealed aperture 52 is shaped and sized to snugly engage the joint 30 to form a substantially fluid-tight seal allowing fluid communication from the cartridge 14 through the conduit 28 to the tip 16. It should be noted that while this is the preferred system of fluid communication between the cartridge 14 and the tip 16, any means of fluid communication between the cartridge 14 and the tip 16 known to one skilled in the art may be chosen.

In operation, the cartridge 14 is placed into the first portion 20 with the foil sealed aperture 52 aligned with the circular joint 30. The second portion 22 is joined with the first portion 20 such that the cartridge 14 is positioned within the inner volume 14 and the biasing member 34 urges the circular joint 30 to engage and break the foil sealed aperture 52. Fingernail polish from the cartridge 14 is then in fluid communication with the tip 16. The tip 16 preferably has sufficient porosity to convey fingernail polish readily therethrough without leaking the fingernail polish therefrom. The surface tension, tackiness and viscosity of fingernail polish is typically such that the polish will not readily leak from the tip portion 16; however, solvent may be evolved through the tip portion 16 such that the tip portion 16 "dries out" and becomes inoperative. Therefore, it is preferred that the front cap 42 be engaged whenever the stylus system 10 is not in use. It is also preferable that a cartridge 14 not be loaded into the stylus system 10 until it is desired to polish fingernails.

It is preferred that the cartridge 14 be sized to hold just enough polish to fully coat one set (i.e., ten) of fingernails. Fingernails may be polished by stroking the tip portion 16 evenly over each nail. The tip portion 16 preferably includes a fine edge or point for performing detailed polish work. After use, the expended cartridge 14 and tip portion 16 may be disposed of. More preferably, the fluid conduit 28 should be cleaned with solvent between uses to prevent clogging and color mixing. Alternately, the cartridge 14 may be sized to hold a larger amount of polish sufficient for multiple polishings. The fingernail polish filling a larger cartridge 14 would preferably be formulated with a solvent having both a relatively low viscosity and low volatility, such that the solvent remains fluid and evaporates slowly.

FIGS. 3–5B illustrate another embodiment of the present invention, a stylus system 10A having an elongated hollow body portion 12A including a collapsibly interlocking first portion 20A and second portion 22A. Preferably, the first portion 20A includes an exterior set of threads 54A and the second portion 22A includes an interior set of threads 56A removably matable with the exterior set of threads 54A. The first and second portions 20A, 22A screw together to form the substantially cylindrical elongated hollow body portion 12A having a variable central inner volume 24A. The magnitude of the central inner volume 24A is a function of the degree to which the respective threads 54A, 56A are interlockingly engaged. In other words, the more the first and second portions 20A, 22A are screwed together, the smaller the inner volume 24A becomes.

The first portion 20A also includes a tip holder 26A adapted to engage a tip portion 16A. The tip portion 16A is preferably formed from some porous material, such as felt, nylon, or sponge. The tip holder 26A is preferably positioned opposite the second portion 24A. The tip holder 26A is connected in fluid communication with the inner volume 24A by a polish conduit 28A. The polish conduit 28A includes a raised, circular joint 30A extending into the inner volume 24A. The second portion 22A preferably includes a tip storage volume 40A wherein spare tips 16A may be kept pending their use.

The stylus system 10A further preferably includes a front cap 42A adapted to fit over an engaged tip 16A and the tip holder 26A. The front cap 42A is preferably further adapted to snugly engage the first portion 20A to minimize solvent leakage therefrom. The stylus system 10A also preferably includes an end cap 50A adapted to enclose the tip storage volume 40A.

The polish or fluid reservoir cartridge 14A is a generally cylindrical container and acts as a reservoir for a volume of fingernail polish. The fluid reservoir cartridge 14A includes a substantially rigid portion 58A attached to a collapsible portion 60A. The fluid reservoir cartridge 14A is preferably sized to fit snugly within the inner volume 24A, although the fluid reservoir cartridge 14A may be sized to fit loosely therein. The substantially rigid portion 58A of the fluid reservoir cartridge 14A is preferably formed from some lightweight structural material such as aluminum, plastic or the like. The collapsible portion 60A is preferably formed of a flexible material such as metal foil, polymer sheet or the like. The fluid reservoir cartridge 14A also preferably includes a foil sealed aperture 52A formed in the substantially rigid portion 58A. The foil sealed aperture 52A is sized to snugly engage the circular joint 30A to form a substantially fluid-tight seal allowing fluid communication from the cartridge 14A, through the conduit 28A and to the tip 16A. It should be noted that while this is the preferred system of fluid communication between the cartridge 14A and the tip 16A, any means of fluid communication between the cartridge 14A and the tip 16A known to one skilled in the art may be chosen.

In operation, the fluid reservoir cartridge 14A is placed into the first portion 20A with the foil sealed aperture 52A aligned with the circular joint 30A. While filled with fingernail polish, the cartridge is quasi-rigid and may be readily so aligned. The second portion 22A is matably connected to the first portion 20A, the respective threads 54A, 56A interlocked until the circular joint 30A is urged to engage and break the foil sealed aperture 52A. Fingernail polish from the cartridge 14A is then put in fluid communication with the tip 16A. The tip 16A preferably has sufficient porosity to convey fingernail polish therethrough without leaking the fingernail polish therefrom. The fingernail polish contained in the fluid reservoir cartridge 14A may have a substantially high viscosity. Further engagement of the respective threads 54A, 56A (i.e., screwing the first body portion 20A and the second body portion 22A further together) diminishes the inner volume 24A and accordingly applies pressure to the fluid reservoir cartridge 14A, urging the fluid reservoir cartridge 14A to likewise decrease in volume. As sufficient pressure is applied to the fluid reservoir cartridge 14A thereto, the collapsible portion 60A collapses, urging polish out of the fluid reservoir cartridge 14A, through the conduit 28A, and out of the tip portion 16A. As more polish is used, the body portions 20A, 22A may be screwed further together to maintain adequate flow of polish through the tip portion 16A.

The surface tension, tackiness and viscosity of fingernail polish is typically such that the polish will not readily leak from the tip portion 16A absent applied pressure; however, solvent may be evolved through the tip portion 16A such that the tip portion 16A "dries out" and becomes inoperative. Therefore, it is preferred that the front cap 42A be engaged whenever the stylus system 10A is not in use. It is also preferable that a cartridge 14A not be loaded into the stylus system 10A until it is desired to polish fingernails.

The cartridge 14A may be sized to hold just enough polish to fully coat one set of fingernails. Fingernails may be coated by stroking the porous tip portion 16A evenly over each nail. After use, the expended cartridge 14A and tip 16A may be disposed of. More preferably, the fluid conduit 28A should be cleaned with solvent between uses to prevent clogging and color mixing. Alternately, the cartridge 14A may be sized to hold a larger amount of polish sufficient for multiple polishings. The fingernail polish filling a larger cartridge 14A would preferably be formulated with a solvent having both a relatively low viscosity and low volatility, such that the solvent remains fluid and evaporates slowly.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are to be desired to be protected.

What is claimed is:

1. A nail polish applicator, comprising;

a hollow body portion;

a fluid reservoir positioned within the hollow body portion;

a disposable porous tip portion connected to the hollow body portion;

a conduit portion in fluid communication with the porous tip portion and the fluid reservoir;

means for changing the volume of the fluid reservoir;

a storage compartment formed in the hollow body portion; and a plurality of porous tip portions in the storage compartment;

wherein the plurality of tip portions includes at least a first stored tip portion and a second stored tip portion;

wherein the first and second stored tip portions are shaped non-identically;

wherein the porous tip portion is adapted to be replaced after each use.

2. The nail polish applicator of claim 1 wherein the means for changing the volume of the fluid reservoir comprises a hollow body portion including a first portion and a second portion threadedly connected together, wherein screwing the first portion and second portion together decreases the volume of the fluid reservoir and wherein screwing the first portion and the second portion apart increases the size of the fluid reservoir.

3. The nail polish applicator of claim 1 further including a cap portion adapted to snugly engage the hollow body portion, wherein the cap portion is adapted to cover the tip portion to minimize evaporation of solvent from the tip portion.

4. The nail polish applicator of claim 1 wherein the fluid reservoir is an at least partially collapsible cartridge.

5. The nail polish applicator of claim 4 wherein the cartridge includes a flexible portion and a substantially rigid portion and wherein the substantially rigid portion further includes an aperture in fluid communication with the conduit.

6. A nail stylus, comprising:

an elongated hollow body portion having a distal portion and a proximal portion and defining a reducible central inner volume therein;

a tip holder formed in the proximal portion;

a porous tip positioned in the tip holder;

a conduit extending in fluid communication between the tip and the central inner volume;

a spare tip storage compartment formed in the distal portion and adapted to contain a plurality of spare tips; and at least two non-identically shaped spare tips contained in the spare tip storage compartment;

wherein the central inner volume contains a nail polish reservoir; and wherein reduction of the central inner volume actuates flow of nail.

7. The nail stylus of claim 6 further comprising a fluid reservoir cartridge positioned within the central inner volume and fluidically connected to the conduit, wherein the fluid reservoir is in fluidic communication with the tip holder.

* * * * *

UNITED STATES PATENT AND TRADEMARK OFFICE

CERTIFICATE OF CORRECTION

PATENT NO. : 6,328,040 B1
DATED : December 11, 2001
INVENTOR(S) : Stein

It is certified that error appears in the above-identified patent and that said Letters Patent is hereby corrected as shown below:

Column 3,
Line 31, replace “cart ridge” with -- cartridge --.

Column 6,
Line 51, insert the following prior to the period:
-- polish from the reservoir through the tip --

Signed and Sealed this

Twentieth Day of August, 2002

*Attest:*

*Attesting Officer*

JAMES E. ROGAN
*Director of the United States Patent and Trademark Office*